US006321545B1

(12) United States Patent
Ota et al.

(10) Patent No.: US 6,321,545 B1
(45) Date of Patent: Nov. 27, 2001

(54) CONTROL APPARATUS FOR VARIABLE DISPLACEMENT TYPE COMPRESSOR

(75) Inventors: Masaki Ota; Masahiro Kawaguchi; Tomoji Tarutani; Taku Adaniya, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/665,808

(22) Filed: Sep. 20, 2000

(30) Foreign Application Priority Data

Sep. 21, 1999 (JP) ..... 11-267033

(51) Int. Cl.[7] ..... F04B 49/00
(52) U.S. Cl. ..... 62/133; 62/228.3; 62/229
(58) Field of Search ..... 62/133, 228.1, 62/228.3, 228.4, 228.5, 229, 196.1, 196.2, 196.3

(56) References Cited

U.S. PATENT DOCUMENTS 5,694,781 * 12/1997 Peterson ..... 62/228.3 X
5,823,000 * 10/1998 Takai ..... 62/133
5,924,296 * 7/1999 Takano et al. ..... 62/228.5 X
6,038,871 * 3/2000 Gutierrez et al. ..... 62/133

FOREIGN PATENT DOCUMENTS 6-341378 12/1994 (JP) .

* cited by examiner

*Primary Examiner*—Harry B. Tanner
(74) *Attorney, Agent, or Firm*—Morgan & Finnegan, LLP

(57) ABSTRACT

An improved control apparatus for a vehicle air conditioning system controls a variable displacement compressor. The discharge capacity of the compressor is changed by changing the difference between the pressure in the crank chamber and the suction pressure. The difference between the pressure in the crank chamber and the pressure of the suction chamber is maintained at a set value. A target value is determined based on the temperature of the passenger compartment. The target value is corrected based on the rotational speed of the engine driving the compressor, which is detected. The set value is determined by the corrected target value.

12 Claims, 3 Drawing Sheets

CONTROL APPARATUS FOR VARIABLE DISPLACEMENT TYPE COMPRESSOR

BACKGROUND OF THE INVENTION

The present invention relates to a variable displacement type compressor for use in vehicle air-conditioners. More particularly, this invention relates to an apparatus for controlling the discharge capacity of a variable displacement type compressor by changing the tilt angle of a cam plate with a control valve.

This type of control apparatus known has a control passage that connects a discharge pressure area to the crank chamber, which houses a cam plate, and adjusts the difference between the pressure in the crank chamber and the pressure in the cylinder bores to change the tilt angle of the cam plate, thereby adjusting the discharge capacity. The adjustment of the difference between the pressure in the crank chamber and the pressure in the cylinder bores is carried out by changing the position of the displacement control valve, which is located in the control passage, under the control of a computer.

Japanese Unexamined Patent Publication (KOKAI) No. Hei 6-341378 discloses a displacement control valve that has a constant differential pressure valve section and an electric driving section. The displacement control valve performs control such that the difference between the pressure of the intake refrigerant gas (hereinafter referred to as the suction pressure), which has a correlation with the pressure in the cylinder bore, and the pressure in the crank chamber becomes equal to a preset value. More specifically, the constant differential pressure valve section adjusts the restriction of the control passage by actuating the valve body to keep the difference between the pressure in the crank chamber and the suction pressure at the preset value. An electric driving section changes a reference set value for the operation of this valve section by adjusting the load acting on the valve body under the control of the computer.

When the suction pressure rises to make the difference between the pressure in the crank chamber and the suction pressure fall below the set value, the valve section actuates the valve body to open the control passage. This increases the amount of the high-pressure refrigerant gas supplied to the crank chamber from the discharge pressure area, thus raising the pressure in the crank chamber. As a result, the difference between the pressure in the crank chamber and the suction pressure is maintained at the preset value.

When the suction pressure falls, making the difference between the pressure in the crank chamber and the suction pressure greater than the set value, on the other hand, the valve section moves the valve body in the direction to close the control passage. This decreases the amount of the high-pressure refrigerant gas supplied to the crank chamber from the discharge pressure area, thus dropping the pressure in the crank chamber. This keeps the difference between the pressure in the crank chamber and the suction pressure at the set value.

The computer compares the temperature detected by a temperature sensor with the temperature set by a temperature setting unit to determine a target value, and controls the electric driving section in such a way that the reference set value for driving the valve section is the target value.

When the cooling load acting on the compressor is heavy, for example, the difference between the temperature detected by the temperature sensor and the temperature set by the temperature setting unit is larger. Based on this large difference, the computer controls the electric driving section to decrease the reference set value for driving the valve section. As a result, the tilt angle of the cam plate increases based on a small difference between the pressure in the crank chamber and the pressure in the cylinder bore, thus increasing the discharge capacity of the compressor in accordance with the heavy cooling load.

When a light cooling load is acting on the compressor, on the other hand, the difference between the temperature detected by the temperature sensor and the temperature set by the temperature setting unit is smaller. Based on this small difference, the computer controls the electric driving section to increase the reference set value for driving the valve section. As a result, the cam plate decreases the tilt angle based on a large difference between the pressure in the crank chamber and the pressure in the cylinder bore via the associated piston, thus reducing the discharge capacity of the compressor in accordance with the light cooling load.

In the above-described compressor, however, moment M in the direction of increasing the tilt angle is acting on a cam plate 102 based on inertial force F of a piston 101 which reciprocates, as shown in FIG. 4. That is, in addition to the difference between the pressure in the crank chamber and the pressure in the cylinder bore via the piston 101, the moment M that acts on the cam plate 102 based on inertial force F of the piston 101 greatly affects the determination of the tilt angle of the cam plate 102. The magnitude of moment M is not always constant. As the rotational speed of the engine increases, the rotational speed of a drive shaft 103 rises too. When the piston 101 reciprocates at a high speed accordingly, the inertial force F of the piston 101 that acts on the cam plate 102 increases, thus making the moment M greater.

FIG. 5 shows a state where the cooling load is constant and the set value for driving the displacement control valve is also constant. In other words, FIG. 5 shows the state where the difference between the pressure in the crank chamber and the pressure in the inertial force F of the piston 101 cylinder bore via the piston 101 is maintained at a certain value. Even in such state, an increase in the rotational speed of the engine driving the compressor and an increase in the inertial force F of the piston 101 will increase the tilt angle of the cam plate 102 or the discharge capacity of the compressor. Such a low-precision control on the discharge capacity of a compressor without considering variation in the inertial force F of the piston 101 is apt to degrade the cooling performance of the air-conditioning system of a vehicle.

SUMMARY OF THE INVENTION

Accordingly, it is an object of the present invention to provide a control apparatus for a variable displacement type compressor that can perform high-precision control of the discharge capacity of the variable displacement type compressor.

To achieve the above object, according to this invention, there is provided a control apparatus for controlling the discharge capacity of a variable displacement type compressor, which has a cam plate supported on a drive shaft to rotate together with the drive shaft in a crank chamber. The apparatus changes the discharge capacity by changing the difference between the pressure in the crank chamber and a suction pressure. The cam plate converts a rotational movement of the drive shaft, which is driven by an engine, to reciprocal movement of the pistons, which compresses gas. The control apparatus includes: a valve for keeping the difference between the pressure in the crank chamber and the suction pressure at a set value; an electric driving mechanism that changes a reference set value, wherein the reference set value is used to operate the valve; an external information detector for outputting information about the temperature of a passenger compartment of the vehicle; a rotational speed sensor for detecting the rotational speed of the engine or a rotational speed related to the rotational speed of the engine; and a computer for determining a target value based on the temperature information and for controlling the electric driving mechanism such that the target value determines the set value, wherein the computer corrects the target value based on rotational speed information from the rotational speed sensor.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENT

One embodiment of the present invention will now be described referring to the accompanying drawings.

To begin with, the structure of a variable displacement type compressor will be described.

Figure 1:
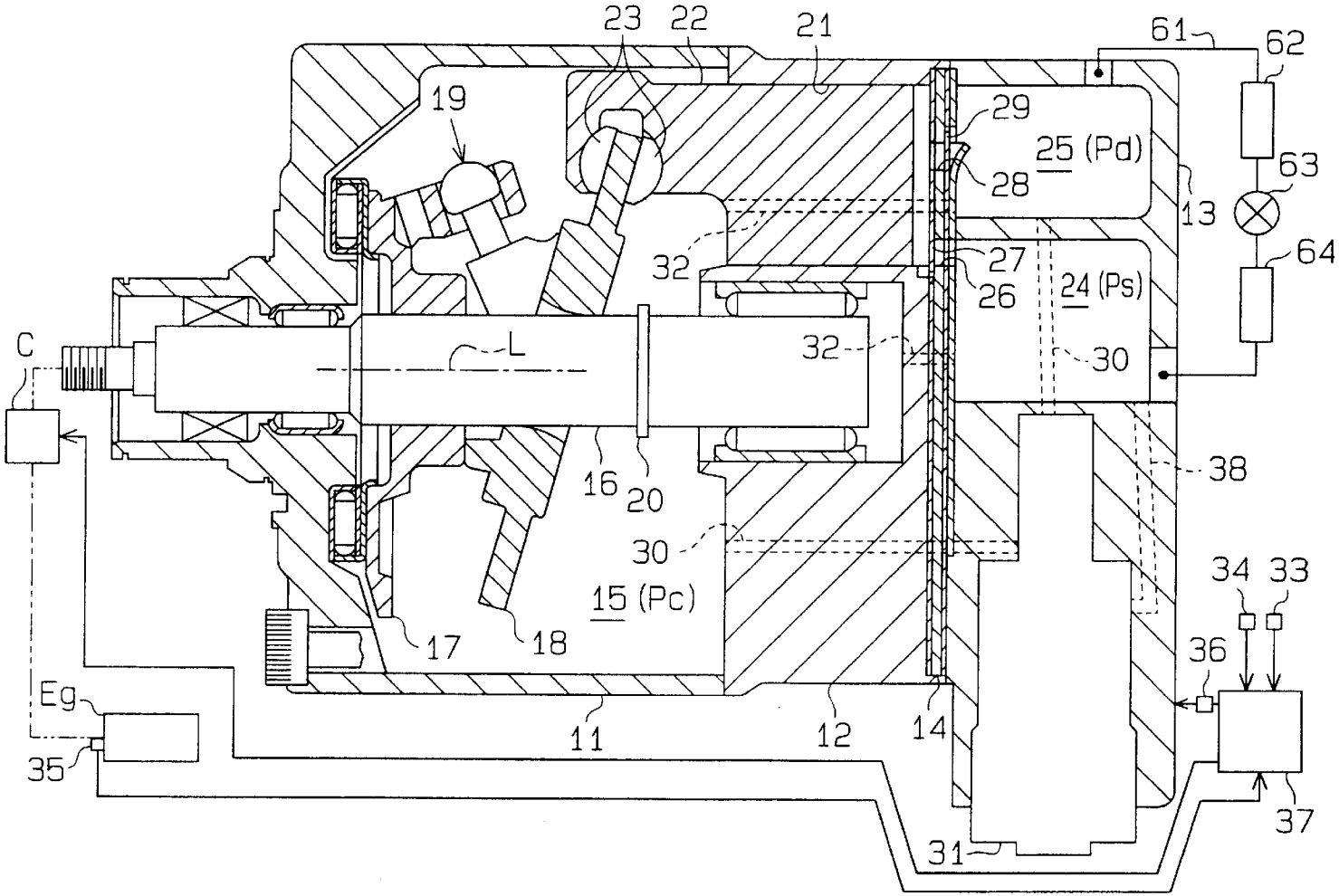
FIG. 1 is a vertical cross-sectional view of a variable displacement type compressor.

As shown in FIG. 1, a front housing member 11 is connected to the front end of a cylinder block 12. A rear housing member 13 is connected to the rear end of the cylinder block 12 via a valve plate 14. The front housing member 11, the cylinder block 12 and the rear housing member 13 constitute the housing of the compressor. A crank chamber 15 is defined by the front housing member 11 and the cylinder block 12.

A drive shaft 16 is supported between the front housing member 11 and the cylinder block 12 and passes through the crank chamber 15. The drive shaft 16 is coupled to an engine Eg via a clutch mechanism C such as an electromagnetic clutch. When the engine Eg runs, therefore, the drive shaft 16 is rotated when the clutch mechanism C is engaged.

A lug plate 17 is fixed to the drive shaft 16 in the crank chamber 15. A swash plate 18 is supported to slide along the surface of the drive shaft 16 and to incline with respect to the drive shaft 16.

A hinge mechanism 19 is located between the lug plate 17 and the swash plate 18. The hinge mechanism 19 permits the swash plate 18 to incline with respect to the axial line L of the drive shaft 16 and to rotate together with the drive shaft 16. As the center portion of the swash plate 18 moves toward the lug plate 17, the tilt angle of the swash plate 18 increases. As the center portion of the swash plate 18 moves toward the cylinder block 12, on the other hand, the tilt angle of the swash plate 18 decreases. A stop 20, which defines the minimum inclination of the swash plate 18, is provided on the drive shaft 16 between the swash plate 18 and the cylinder block 12. The maximum tilt angle of the swash plate 18 is defined by the abutment of the swash plate 18 against the lug plate 17.

A plurality of cylinder bores (only one shown in FIG. 1) 21 are formed through the cylinder block 12. A one-headed piston 22 is retained in each cylinder bore 21. Each piston 22 is attached to the periphery of the swash plate 18 via a shoe 23 and reciprocates forward and backward in the cylinder bore 21 as the swash plate 18 rotates.

A suction chamber 24, which forms a suction pressure area, and a discharge chamber 25, which forms a discharge pressure area, are defined in the rear housing member 13. A suction port 26, suction valve 27, discharge port 28 and discharge valve 29 are formed in the valve plate 14. As the piston 22 moves from the top dead center to the bottom dead center, refrigerant gas in the suction chamber 24 is drawn into the cylinder bore 21 via the suction port 26 and the suction valve 27. As the piston 22 moves from the bottom dead center to the top dead center, the refrigerant gas drawn into the cylinder bore 21 is compressed to a predetermined pressure and is then discharged to the discharge chamber 25 via the discharge port 28 and the discharge valve 29.

In the above-described compressor, the suction chamber 24 and the discharge chamber 25 are connected by an external refrigeration circuit 61, which has a condenser 62, an expansion valve 63 and an evaporator 64.

A control apparatus for controlling the discharge capacity of the compressor will now be discussed.

As shown in FIG. 1, a control passage 30 connects the discharge chamber 25 to the crank chamber 15. A displacement control valve 31 is located in the control passage 30. A bleed passage 32 connects the crank chamber 15 to the suction chamber 24. A pressure transmitting passage 38 extends between the suction chamber 24 and the displacement control valve 31.

A temperature setting unit 33 for setting the temperature of the vehicle passenger compartment, a temperature sensor 34 for detecting the temperature in the passenger compartment (the sensor 34 is located in the passenger compartment in this embodiment) or a temperature that reflects the passenger compartment temperature (in which case, the sensor 34 may be located, for example, near the evaporator 64), a rotational speed sensor 35 for detecting the rotational speed of the output shaft (not shown) of the engine Eg, and the clutch mechanism C are connected to a computer 37. The computer 37 is connected to the displacement control valve 31 via a drive circuit 36.

The structure of the displacement control valve 31 will be discussed below.

Figure 2:
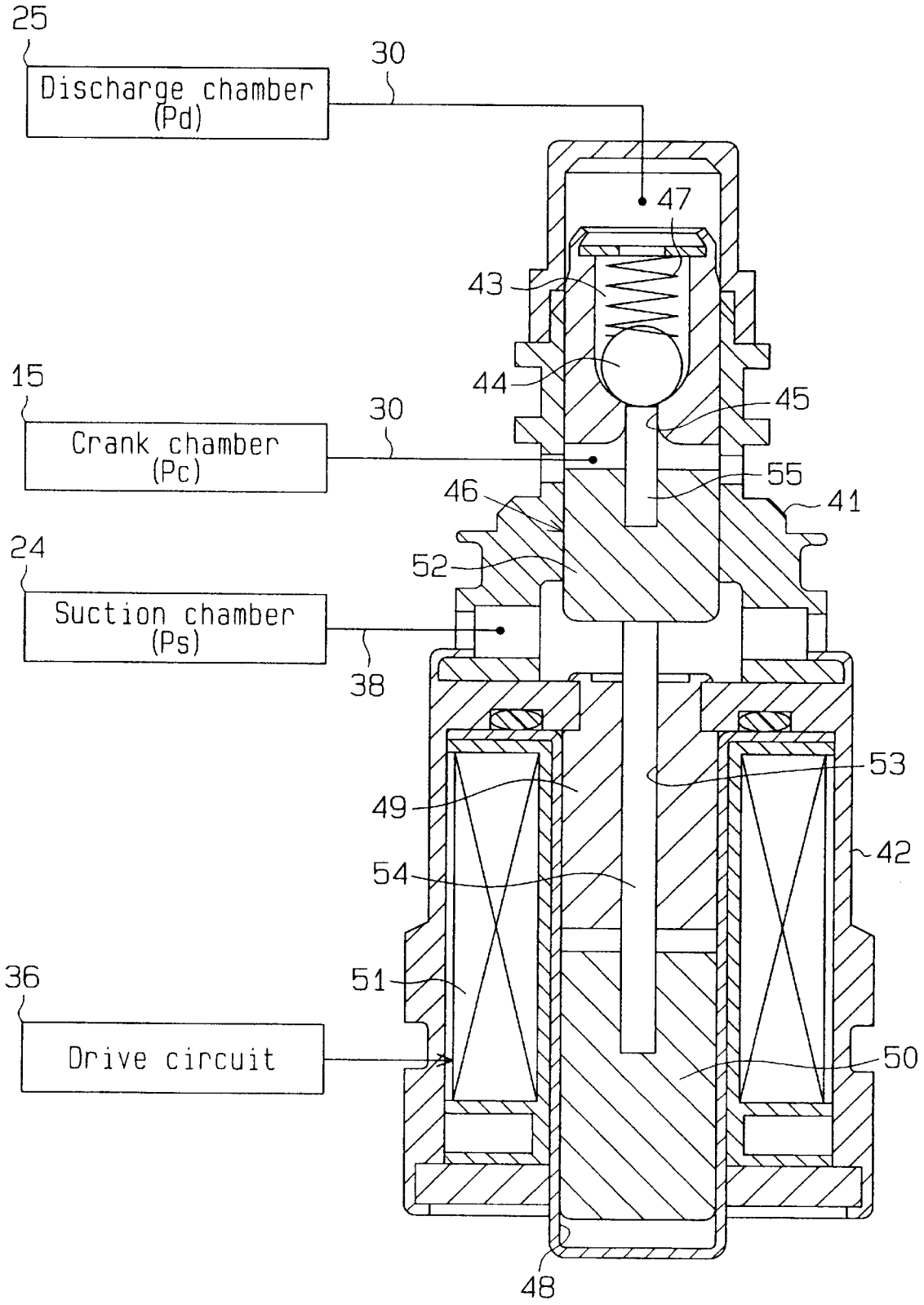
FIG. 2 is a cross-sectional view of a displacement control valve.

In the displacement control valve 31, as shown in FIG. 2, a valve housing 41, which has a valve section 46, is connected to a solenoid section 42, which is also referred to as an electric driving section. A valve chamber 43 is formed in a distal end of the valve housing 41. A spherical valve body 44 is retained in the valve chamber 43 and is movable in the axial direction (in the vertical direction in FIG. 2) of the valve housing 41. A valve hole 45 faces the valve body 44 in the valve chamber 43. A spring 47, which is housed in the valve chamber 43, urges the valve body 44 in the direction to close the valve hole 45. The valve hole 45 extends in the axial direction of the valve housing 41. The valve chamber 43 communicates with the discharge chamber 25 via an upstream section of the control passage 30.

A pressure-receiving member 52 is retained in the valve housing 41 and is axially reciprocated. A lower end of an actuator rod 55 is secured to the pressure-receiving member 52, and an upper end of the actuator rod 55 is inserted in the valve hole 45, so that the upper end abuts against the valve body 44. The upper and lower directions being referred to are the upper and lower directions of FIG. 1. The space between the top surface of the pressure-receiving member 52 and the valve hole 45 is connected to the crank chamber 15 via a downstream section of the control passage 30. The space between the bottom surface of the pressure-receiving member 52 and the solenoid section 42 (more specifically, a fixed attracting member 49 to be discussed later) is connected to the suction chamber 24 via the pressure transmitting passage 38. The valve chamber 43, the valve hole 45, the spring 47, the pressure transmitting passage 38, the valve body 44, the pressure-receiving member 52, the actuator rod 55 are included the valve section 46.

A plunger chamber 48 is formed in the solenoid section 42, and the fixed attracting member 49 is securely fitted in its upper opening. A plunger 50 is accommodated in the plunger chamber 48 and is axially reciprocate. A cylindrical coil 51 is located around the plunger chamber 48, the fixed attracting member 49, and the plunger 50. The drive circuit 36 is connected to the coil 51.

A rod guide hole 53 passes through the fixed attracting member 49. A drive rod 54 is fitted in the rod guide hole 53 in a slidable manner. The lower end of the drive rod 54 is fixed to the plunger 50, and the upper end of the drive rod 54 abuts against the bottom surface of the pressure-receiving member 52. Therefore, the plunger 50 and the valve body 44 are functionally coupled by the drive rod 54, the pressure-receiving member 52 and the actuator rod 55.

The operation of the above-described control apparatus will now be discussed.

When the engine Eg is activated, when the temperature detected by the temperature sensor 34 is equal to or higher than the temperature set by the temperature setting unit 33, and when an unillustrated activation switch of the air-conditioning system is on, the computer 37 engages the clutch mechanism C, thus causing the compressor to be driven by the engine Eg.

When the compressor is activated, the pressure Pc in the crank chamber 15 acts on the upper surface of the pressure-receiving member 52 and the pressure Ps of the intake refrigerant gas (hereinafter referred to as the suction pressure) acts on the bottom surface of the member 52. Downward force is applied to the plunger 50 of the solenoid section 42 by the pressure-receiving member 52 and the drive rod 54 in accordance with the difference between the pressure Pc in the crank chamber 15 and the suction pressure Ps ($Pc \geqq Ps$).

When the clutch mechanism C is engaged, the computer 37 determines the input current value based on external information, such as the temperature set by the temperature setting unit 33 and the temperature detected by the temperature sensor 34, and instructs that the determined input current be sent to the drive circuit 36.

The drive circuit 36 sends the specified input current value to the coil 51 of the displacement control valve 31. As the current is supplied to the coil 51 from the drive circuit 36, a force of attraction (electromagnetic force) resulting from the input current is produced between the fixed attracting member 49 and the plunger 50. This attracting force acts on the valve body 44 via the drive rod 54, the pressure-receiving member 52 and the actuator rod 55 in the direction to open the valve hole 45 (the upward direction).

Therefore, the opening size of the valve hole 45 of the displacement control valve 31 is determined essentially by a balance between the downward force based on the difference between the pressure Pc in the crank chamber 15 and the suction pressure Ps, which acts on the pressure-receiving member 52, and the upward force based on the attracting force between the fixed attracting member 49 and the plunger 50.

Suppose that the attracting force between the fixed attracting member 49 and the plunger 50 is constant. In this case, as the suction pressure Ps rises, which reduces the difference between the suction pressure Ps and the pressure Pc in the crank chamber 15, the downward force from the pressure-receiving member 52 that acts on the plunger 50 becomes weaker. This makes the urging force of the solenoid section 42 that acts on the valve body 44 in the upward direction and opens the valve hole 45 relatively stronger. As a result, the valve body 44 is moved in the direction of opening the valve hole 45 against the force of the spring 47. This increases the amount of high-pressure refrigerant gas (Pd) supplied to the crank chamber 15 from the discharge chamber 25, which raises the pressure Pc in the crank chamber 15; therefore, the difference between the pressure Pc in the crank chamber 15 and the suction pressure Ps is maintained at the set value.

When the difference between the pressure Pc in the crank chamber 15 and the suction pressure Ps increases, on the other hand, the downward force from the pressure-receiving member 52 that acts on the plunger 50 increases. This relatively reduces the urging force of the solenoid section 42 that acts on the valve body 44 in the direction of opening the valve hole 45. As a result, the valve body 44 is moved in the direction of closing the valve hole 45 due to the force of the spring 47. This decreases the amount of high-pressure refrigerant gas (Pd) supplied to the crank chamber 15 from the discharge chamber 25, which lowers the pressure Pc in the crank chamber 15, and the difference between the pressure Pc in the crank chamber 15 and the suction pressure Ps is maintained at the set value.

Thus, the valve section 46 actuates the valve body 44 such that the difference between the pressure Pc in the crank chamber 15 and the suction pressure Ps, which correlates with the pressure in the cylinder bores 21, is kept at the set value. That is, the valve section 46 operates to keep constant the difference between the pressure Pc in the crank chamber 15, which determines the tilt angle of the swash plate 18, and the pressure in the cylinder bores 21, thus making the tilt angle of the swash plate 18 (the discharge capacity of the compressor) constant.

As described above, the reference set value for the operation of the valve section 46 or the discharge capacity of the compressor can be adjusted externally by changing the attracting force between the fixed attracting member 49 and the plunger 50.

When the cooling load is heavy the difference between the detected temperature and the set temperature becomes large. Based on the large difference between the detected temperature and the set temperature, the computer 37 controls the input current value to the coil 51 of the displacement control valve 31 to reduce the set value, which increases the discharge capacity of the compressor. That is, the computer 37 instructs the drive circuit 36 to reduce the input current value to the coil 51 as the temperature difference increases, which increases the attracting force between the fixed attracting member 49 and the plunger 50. Therefore, the solenoid section 42 reduces the force acting on the pressure-receiving member 52 in the direction of opening the valve hole 45. Consequently, the valve section 46 moves the valve body 44 to reduce the opening size of the valve hole 45, which reduces the difference between the pressure Pc in the crank chamber 15 and the suction pressure Ps and increases the discharge capacity of the compressor.

When the cooling load is light, on the other hand, the difference between the detected temperature and the set temperature is relatively small. Based on the small difference between the detected temperature and the set temperature, the computer 37 increases the input current value to the coil 51 of the displacement control valve 31, which reduces the discharge capacity of the compressor. That is, the computer 37 instructs the drive circuit 36 to increase the input current to the coil 51 as the temperature difference decreases, which increases the attracting force between the fixed attracting member 49 and the plunger 50. The solenoid section 42 therefore increases the force acting on the pressure-receiving member 52 in the direction of opening the valve hole 45. As a result, the valve section 46 moves the valve body 44 to increase the opening size of the valve hole 45, which increases the difference between the pressure Pc in the crank chamber 15 and the suction pressure Ps and reduces the discharge capacity of the compressor.

Figure 4:
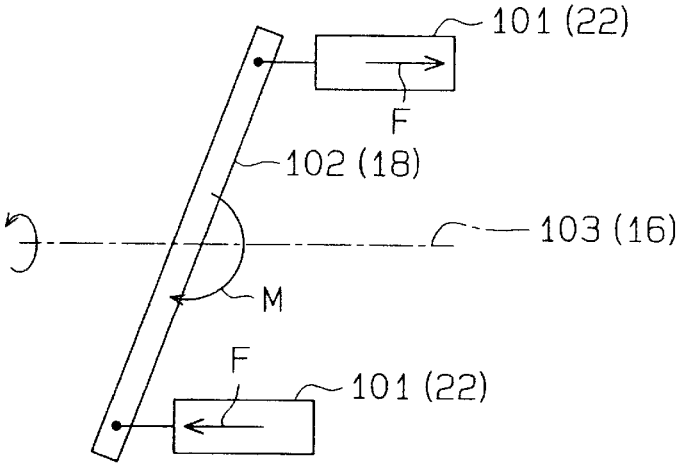
Fig.4(Prior Art)
FIG. 4 is a diagram for illustrating how the rotational speed of the engine driving the compressor influences the discharge capacity control of the variable displacement type compressor.

According to the prior art, with reference to FIG. 4, the factors that determine the discharge capacity of the compressor include the moment that acts on the swash plate 18 based on the reciprocation of the piston 22 in addition to the difference between the pressure Pc in the crank chamber 15 and the pressure in the cylinder bore 21. Therefore, determining the input current value (target set value) to the coil 51 of the displacement control valve 31, which does not reflect the variation in the moment F due to the pistons 22, i.e., the changes caused by variation in the rotational speed of the engine Eg, reduces the precision of the discharge capacity control, thus deteriorating the air-conditioning performance.

According to this invention, therefore, the determination of the input current value (target set value) to the coil 51 of the displacement control valve 31 is allowed to reflect variation in the rotational speed information of the engine Eg, which is detected by the rotational speed sensor 35. The computer 37 instructs the drive circuit 36 to output a corrected input current value (target value), which is acquired by adding a correction amount that is determined in accordance with the rotational speed detected by the rotational speed sensor 35 to the uncorrected input current value, which has been computed based on the difference between the detected temperature from the temperature sensor 34 and the temperature set by the temperature setting unit 33. The correction amount is prestored in the computer 37 as correction map data, which has the rotational speed of the engine Eg as a parameter.

Figure 5:
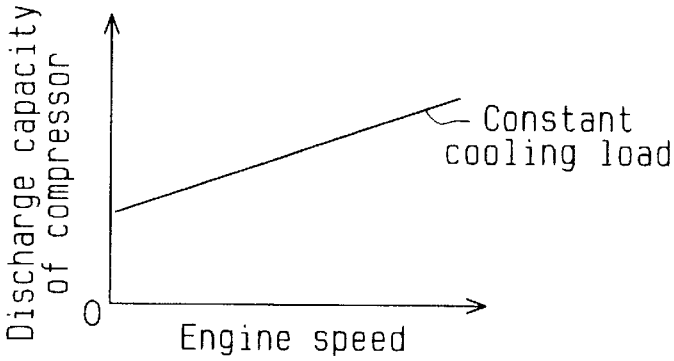
Fig.5(Prior Art)
FIG. 5 is a graph showing the relationship between the rotational speed of the engine driving the compressor and the discharge capacity of a variable displacement type compressor according to a conventional control apparatus.

That is, the higher the rotational speed of the engine Eg becomes, the greater the moment F of the piston 22 that acts on the swash plate 18 becomes. If the uncorrected input current value is sent to the coil 51, the discharge capacity of the compressor is changed by a greater amount than when the rotational speed of the engine Eg is low (see FIG. 5). Therefore, the computer 37 corrects the uncorrected input current value to increase as the rotational speed of the engine Eg increases. Accordingly, the computer 37 instructs the drive circuit 36 to send the corrected input current value, which adds to the uncorrected set value, to the coil 51.

Figure 3A:
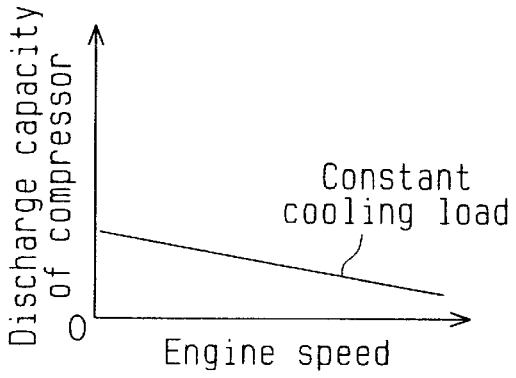
FIG. 3A is a graph showing the relationship between the rotational speed of a vehicular engine and the discharge capacity of the variable displacement type compressor.

Particularly, as shown in FIG. 3A, the correction map data is such that the discharge capacity decreases as the rotational speed of the engine Eg increases on the assumption that the cooling load (uncorrected input current value) is constant.

Figure 3B:
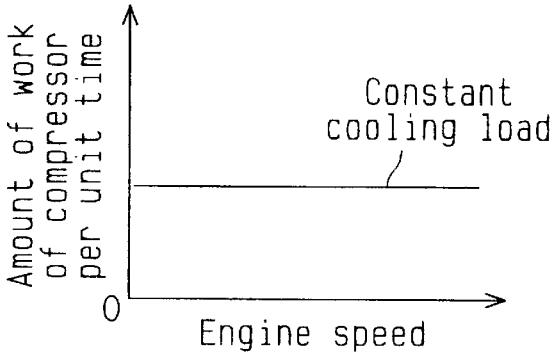
FIG. 3B is a graph showing the relationship between the rotational speed of the vehicular engine and the amount of work of the variable displacement type compressor per unit time.

Further, the correction map data is set in such a way that the discharge amount of refrigerant gas from the compressor to the external refrigeration circuit 61 per unit time, or the amount of work of the compressor per unit time, becomes substantially constant, regardless of the rotational speed of the engine Eg on the assumption that the cooling load is constant, as shown in FIG. 3B. Note that the amount of work done by the compressor per unit time can be expressed by the amount of work of the compressor (which is determined by the discharge capacity of the compressor) per unit rotation of the drive shaft 16 multiplied by the rotational speed of the drive shaft 16 (which is determined by the rotational speed of the engine Eg).

According to this invention, the rotational speed of the engine Eg is reflected in determining the target value for the displacement control valve 31. It is therefore possible to control the discharge capacity of the compressor with a high precision by accounting for a variation in the moment F of the pistons 22.

Given that the cooling load is constant, the correction map data is set such that, as the rotational speed of the engine Eg increases, the discharge capacity decreases. Thus, the amount of work done by the compressor per unit time is not changed much by a variation in the rotational speed of the engine Eg, which improves the cooling performance of the air-conditioning system.

The rotational speed sensor 35 detects the rotational speed of the engine Eg, which is essential information in the general control of the engine Eg. Since a this rotational speed sensor 35 is provided in nearly all vehicles, it is unnecessary to provide a special unit to implement this control.

Although a single embodiment of the present invention has been described herein, it should be apparent to those skilled in the art that the present invention may be embodied in many other specific forms without departing from the spirit or scope of the invention. Particularly, it should be understood that the invention may be embodied in the following forms.

A sensor that detects the rotational speed of the drive shaft 16 may be used instead of an engine speed sensor.

This invention may be embodied into a control apparatus for a variable displacement type compressor that alters the discharge capacity as the size of the bleed passage alone is adjusted by the displacement control valve.

This invention may be embodied into a control apparatus for a variable displacement type compressor that changes the discharge capacity as the opening sizes of both the control passage and the bleed passage are adjusted by the displacement control valve.

The set value may decrease as the input current value to the coil increases and may increase as this input current value decreases.

In the above-described embodiment, the control of energization of the coil 51 is analog current-based control. This control may be changed to duty control.

Therefore, the present examples and embodiments are to be considered as illustrative and not restrictive and the invention is not to be limited to the details given herein, but may be modified within the scope and equivalence of the appended claims.

What is claimed is:

1. A control apparatus for controlling the discharge capacity of a variable displacement type compressor for a vehicle, wherein the compressor has a cam plate supported on a drive shaft to rotate together with the drive shaft, in a crank chamber, wherein the apparatus changes the discharge capacity by changing the difference between the pressure in the crank chamber and a suction pressure, wherein the cam plate converts a rotational movement of the drive shaft, which is driven by an engine, to reciprocal movement of the pistons, which compresses gas, the control apparatus comprising:

a valve for keeping the difference between the pressure in the crank chamber and the suction pressure at a set value;

an electric driving mechanism that changes a reference set value, wherein the reference set value is used to operate the valve;

an external information detector for outputting information about the temperature of a passenger compartment of the vehicle;

a rotational speed sensor for detecting the rotational speed of the engine or a rotational speed related to the rotational speed of the engine;

a computer for determining a target value based on the temperature information and for controlling the electric driving mechanism such that the target value determines the set value, wherein the computer corrects the target value based on rotational speed information from the rotational speed sensor.

2. The control apparatus according to claim 1, wherein the apparatus includes a passenger compartment temperature setting unit for setting the passenger compartment temperature, and the computer determines the target value based on the temperature information from the passenger compartment temperature sensor and the set temperature information from the passenger compartment temperature setting unit.

3. The control apparatus according to claim 1, wherein, under a constant cooling load, the computer increases the target value as the rotational speed detected by the rotational speed sensor increases.

4. The control apparatus according to claim 3, wherein the computer increases the target value to reduce the discharge capacity of the compressor.

5. The control apparatus according to claim 4, wherein, under a constant cooling load, the computer increases the target value as the rotational speed detected by the rotational speed sensor increases, such that the work of the compressor per unit time is substantially constant regardless of the rotational speed of the engine.

6. A control apparatus for controlling the discharge capacity of a variable displacement type compressor for a vehicle, wherein the apparatus changes the discharge capacity by changing the difference between the pressure in a crank chamber and a suction pressure, wherein the compressor compresses refrigerant gas, which is supplied into the cylinder bores from an external refrigeration circuit via a suction chamber, through reciprocating movement of pistons in the cylinder bores, the pistons being reciprocated by a cam plate that is supported on a drive shaft and rotates together with the drive shaft in the crank chamber, wherein the drive shaft is driven by an engine, the refrigerant gas being discharged via a discharge chamber, the control apparatus comprising:

a valve for maintaining the difference between the pressure in the crank chamber and the suction pressure at a set value, the valve having a valve body that moves to adjust the pressure in the crank chamber;

an electric driving mechanism that changes the set value by adjusting a load applied to the valve body;

a sensor for indicating the temperature of a passenger compartment of the vehicle;

a passenger compartment temperature setting unit for setting a target temperature for the passenger compartment;

a rotational speed sensor for detecting the rotational speed of the engine or a rotational speed related to the rotational speed of the engine;

a computer for determining a target value based on the temperature of the passenger compartment and the set target temperature, wherein the computer controls the mechanism such that the target value determines the set value, wherein the computer corrects the target value based on the rotational speed detected by the rotational speed sensor.

7. The control apparatus according to claim 6, wherein the valve body adjusts the pressure in the crank chamber by selectively connecting the crank chamber to the discharge chamber.

8. The control apparatus according to claim 6, wherein, under a constant cooling load, the computer increases the target value as the rotational speed detected by the rotational speed sensor increases.

9. The control apparatus according to claim 8, wherein the computer increases the target value to reduce the discharge capacity of the compressor.

10. The control apparatus according to claim 9, wherein, under a constant cooling load, the computer increases the target value as the rotational speed detected by the rotational speed sensor increases, such that the work of the compressor per unit time is substantially constant regardless of the rotational speed of the engine.

11. A method for controlling the discharge capacity of a variable displacement type compressor for a vehicle, wherein the apparatus changes the discharge capacity by changing the difference between the pressure in a crank chamber and a suction pressure, wherein the compressor compresses refrigerant gas, which is supplied into the cylinder bores from an external refrigeration circuit via a suction chamber, through reciprocating movement of pistons in the cylinder bores, the pistons being reciprocated by a cam plate that is supported on a drive shaft and rotates together with the drive shaft in the crank chamber, wherein the drive shaft is driven by an engine, the refrigerant gas being discharged via a discharge chamber, the method comprising:

determining a target value concerning the discharge capacity of the compressor based on temperature information;

correcting the target value based on the rotational speed of the engine or a rotational speed related to the rotational speed of the engine; and moving a valve body located between the crank chamber and the discharge chamber in accordance with the corrected target value to adjust the pressure in the crank chamber so that the difference between the pressure in the crank chamber and the suction pressure is decreased to the corrected target value.

12. The control method according to claim 11, wherein the moving step includes selectively connecting the crank chamber to the discharge chamber to adjust the pressure in the crank chamber.

* * * * *